US008282510B1

(12) United States Patent
Englund

(10) Patent No.: US 8,282,510 B1
(45) Date of Patent: Oct. 9, 2012

(54) BASEBALL TRAINING BAT

(76) Inventor: James D. Englund, Bellevue, WA (US)

( * ) Notice: Subject to any disclaimer, the term of this patent is extended or adjusted under 35 U.S.C. 154(b) by 0 days.

(21) Appl. No.: 12/586,506

(22) Filed: Sep. 23, 2009

Related U.S. Application Data

(60) Provisional application No. 61/194,224, filed on Sep. 24, 2008.

(51) Int. Cl.
*A63B 69/00* (2006.01)
*A63B 59/00* (2006.01)

(52) U.S. Cl. ..... 473/457; 473/422; 473/464

(58) Field of Classification Search ..... 473/422, 473/437, 457, 451, 564, 565, 567, 228, 226; D21/725, 724, 722
See application file for complete search history.

(56) References Cited

U.S. PATENT DOCUMENTS

| | | | | | |
|---|---|---|---|---|---|
| 3,246,894 | A | | 4/1966 | Salisbury | |
| 3,268,226 | A | | 8/1966 | Martino | |
| 3,463,492 | A | * | 8/1969 | White | 473/453 |
| 3,809,397 | A | * | 5/1974 | Gruenewald | 473/457 |
| 3,833,217 | A | * | 9/1974 | Greaney | 473/457 |
| 3,944,225 | A | * | 3/1976 | Greaney | 473/457 |
| 4,416,451 | A | * | 11/1983 | Solloway | 482/111 |
| 4,682,773 | A | | 7/1987 | Pomilia | |
| 5,002,275 | A | * | 3/1991 | Beutler et al. | 473/228 |
| 5,058,890 | A | * | 10/1991 | Szabo | 473/457 |
| 5,165,683 | A | * | 11/1992 | Beutler et al. | 473/228 |
| 5,207,625 | A | * | 5/1993 | White | 482/111 |
| 5,395,107 | A | * | 3/1995 | De Pippo | 473/451 |
| 5,571,048 | A | * | 11/1996 | Kenney | 473/228 |
| 5,888,154 | A | * | 3/1999 | Hartman | 473/457 |
| 6,866,592 | B1 | * | 3/2005 | Gitre | 473/437 |
| 7,090,618 | B2 | * | 8/2006 | Stout et al. | 482/55 |
| 7,112,152 | B1 | * | 9/2006 | Chen | 473/457 |
| 7,118,490 | B2 | * | 10/2006 | Namba | 473/228 |
| 7,935,009 | B2 | | 5/2011 | Mullin | |
| 7,993,220 | B2 | * | 8/2011 | Enday | 473/463 |
| 2008/0261730 | A1 | * | 10/2008 | Mullin | 473/457 |

* cited by examiner

*Primary Examiner* — Mitra Aryanpour
(74) *Attorney, Agent, or Firm* — Seed IP Law Group PLLC

(57) ABSTRACT

One embodiment of the present baseball training bat is comprised of a hollow tube with a handle portion and a knob attached at the proximal end. A hitting portion is attached at the distal end of the tube that provides two elongated, opposed striking surfaces that are narrower than the striking surface of a conventional baseball bat, and are offset from the axis for improving swing accuracy and wrist control. The relative weights of the components combine to produce a training bat that is substantially similar in overall weight and balance to a conventional baseball bat. The face of each narrow striking surface is substantially similar in convexity to the striking surface of a conventional baseball bat, thereby providing a familiar feel and sound to the hitter when used to hit a ball.

13 Claims, 3 Drawing Sheets

BASEBALL TRAINING BAT

CROSS-REFERENCE TO RELATED APPLICATIONS

This application claims the benefit of provisional patent application Ser. No. 61/194,224, filed 2008 Sep. 24 by the present inventor.

FEDERALLY SPONSORED RESEARCH

Not Applicable

SEQUENCE LISTING OR PROGRAM

Not Applicable

BACKGROUND

1. Field

This application relates generally to baseball bats, particularly to training bats with reduced hitting surface for use in improving hitting accuracy and bat control, and for improving the transition from the metal and composite bats used in collegiate games to wood bats of the type used in professional games.

2. Prior Art

In the field of competitive sport, it is generally accepted that hitting a pitched baseball is among the most difficult of skills to acquire and maintain. Acquiring and maintaining this skill requires dedication and many hours of precise batting practice. Batting practice methods are commonly designed to train a hitter in the most exacting and efficient manner possible, without which, the batter is unlikely to acquire or maintain such skill.

A conventional regulation baseball bat is comprised of a larger diameter hitting portion and a much smaller diameter handle portion, both being circular in cross-section. The hitting portion is larger for hitting the ball easier, and also heavier for positioning the center of gravity closer to the distal end of the bat for greater hitting power.

Wood bats, with their laminar grain structure, are traditionally gripped by the batter such that a ball may be struck consistently along a narrow zone that runs the length of the bat's striking surface and which corresponds with the exposed edge-grain of the wood, regarded generally as being the optimal impact area for greatest bat strength and energy transfer to the ball. Accordingly, the large trademark label of a wood bat is traditionally placed to help indicate grain orientation such that the batter can easily see it and quickly determine how to set his grip for optimum bat performance. Although composite and aluminum bats have no laminar grain structure, batters using these bats also benefit by using a grip and swing that optimizes energy transfer to the ball.

A common ability shared by skilled batters as they swing is the tendency to not turn, or roll, the bat's striking surface as it approaches the ball. Skilled batters are able to set their grip and keep a relatively small, narrow zone of the bat's striking surface directed toward the ball, consistently making contact in this zone despite having to make rapid adjustments to the height of a pitched ball as it approaches anywhere from high to low in the batter's hitting zone. Such consistency in the area of contact on the bat results in better hitting performance in the form of improved ball flight and improved energy transfer to the ball. Normally, this means more hits into fair territory, more line drives, and harder hits. Batters of lesser skill typically do not have the wrist control to keep from turning, or rolling, the striking surface during their swing as they try to adjust to pitched balls of varying heights. This can lead to contact with the bat of a much more random nature around its striking surface, often yielding less desirable results, such as pop-ups, ground balls and softly hit balls.

A training bat disclosed in U.S. Pat. No. 3,246,894 to Salisbury is, in one embodiment, provided with a flattened portion as the intended striking surface. The flat striking surface trains the batter to set and maintain a grip that keeps the striking surface directed toward the ball. Since the flat striking surface is a relatively large area, it is much easier to make contact with the ball than with a conventional bat and is therefore unlikely to improve a batter's hand-eye coordination. Since the flat striking surface is not convex and is positioned relatively close to the axis of the bat, it is unlikely to create a feel and sound that is familiar to the batter when hitting a baseball.

Another training bat disclosed in U.S. Pat. No. 3,268,226 to Martino is provided with an opening in the distal end in a location normally associated with a bat's optimum point of contact and is large enough to allow a baseball to pass through. Like the previous example, this bat also trains the batter to set and maintain a grip and swing that, in this case, keeps the opening directed toward the ball such that when properly swung, the ball passes through the bat and is caught in a small net affixed to the back side of the opening. Since the intended purpose of this bat is to catch, rather than hit, a ball, it is unlikely to render a training exercise that provides immediate feedback of the type that is gained by actually hitting a ball and watching the result.

Some prior art training bats seek to improve batter skill by providing a reduced area for the striking surface. For example, a training bat disclosed in U.S. Pat. No. 4,682,773 to Pomilia, is provided with a uniform diameter through its length. The small diameter of the bat is intended to improve hand-eye coordination. Since the hitting portion of the bat is circular in cross-section, it is unlikely to train the batter to not turn, or roll, the striking surface as he swings. Further, since the diameter, and therefore convexity, of the striking surface is much smaller than that of a conventional bat, and since its weight is biased toward the handle, rather than toward the hitting portion, it is unlikely to create a feel and sound that is familiar to the batter when hitting a ball.

SUMMARY

In accordance with one embodiment, a training bat is comprised of a hollow tube with a handle portion that includes a conventional knob and an attached hitting portion of predetermined weight. The hitting portion features two elongated, opposing narrow lobes which are offset from, and parallel to, the axis of the bat and whereof the outermost surface is the intended striking surface, training the batter to set and maintain a grip which directs the striking surface toward the ball throughout his swing to the moment of contact. The challenge of hitting with a narrow striking surface, and of using a grip and swing which directs the striking surface toward the ball without turning, or rolling it away from the ball, combined with immediate feedback gained from hitting a ball using a bat that handles and feels substantially similar to a conventional bat provides a training exercise that is precise and efficient.

DRAWINGS

Figures

DRAWINGS

Reference Numerals

10. Handle Portion
12. Knob
14. Hitting Portion
16. Proximal End
18. Cut-off End, Hitting Portion
20. Centered Bore, Hitting Portion
22. Narrow Lobe
24. Striking Surface
26. Outer Lobe Edge
28. Hole
30. Distal End

DETAILED DESCRIPTION

First Embodiment

Figure 1:
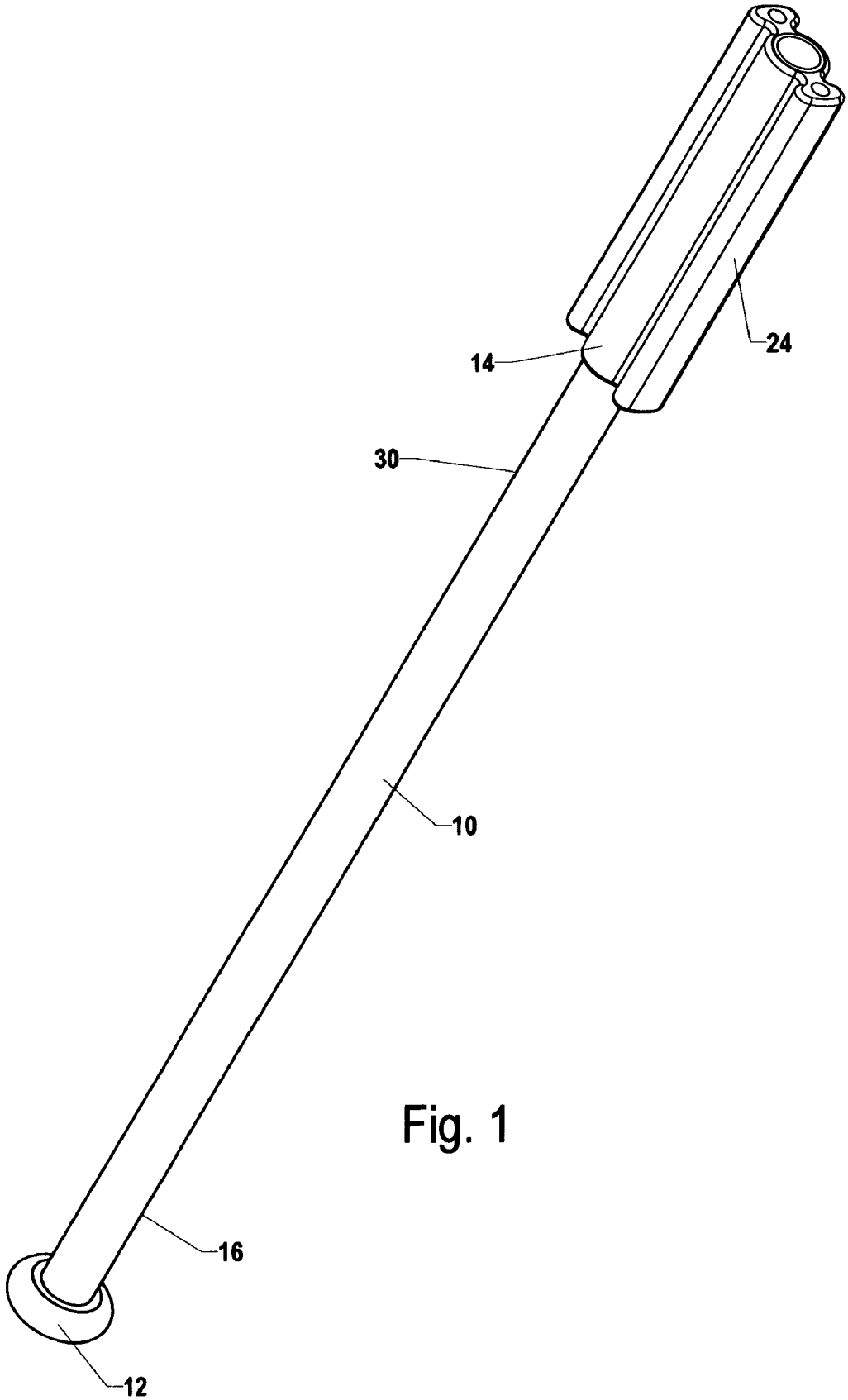
FIG. 1 is a perspective view of the first embodiment of the present training bat.

FIG. 1:

One embodiment of the present baseball training bat is shown in a perspective view in FIG. 1. It is comprised of a handle portion 10 and an attached hitting portion 14. Hitting portion has a substantially narrower striking surface than the continuous, round striking surface of a conventional baseball bat. Hitting portion retains certain conventional baseball bat characteristics such as axial length of the striking surface, convexity of the striking surface, and offset distance between the striking surface and the axis of the bat. Since great accuracy in a batter's swing and wrist control are required to hit a ball squarely and consistently with such a narrow and non-continuous striking surface, the batter's skill is improved by practicing with the present training bat.

Handle portion 10 is preferably made of a single metal tube of uniform outside diameter throughout for simplicity. The preferable outside diameter of tube is about 0.87 to 1.00 inch. A knob 12 is attached to a proximal end 16 of tube whereby tube is inserted into knob and welded or otherwise bonded together permanently.

Figure 2:
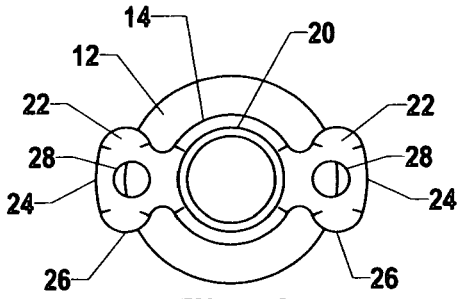
FIG. 2 is a top view of the first embodiment of the present training bat.
Figure 3:
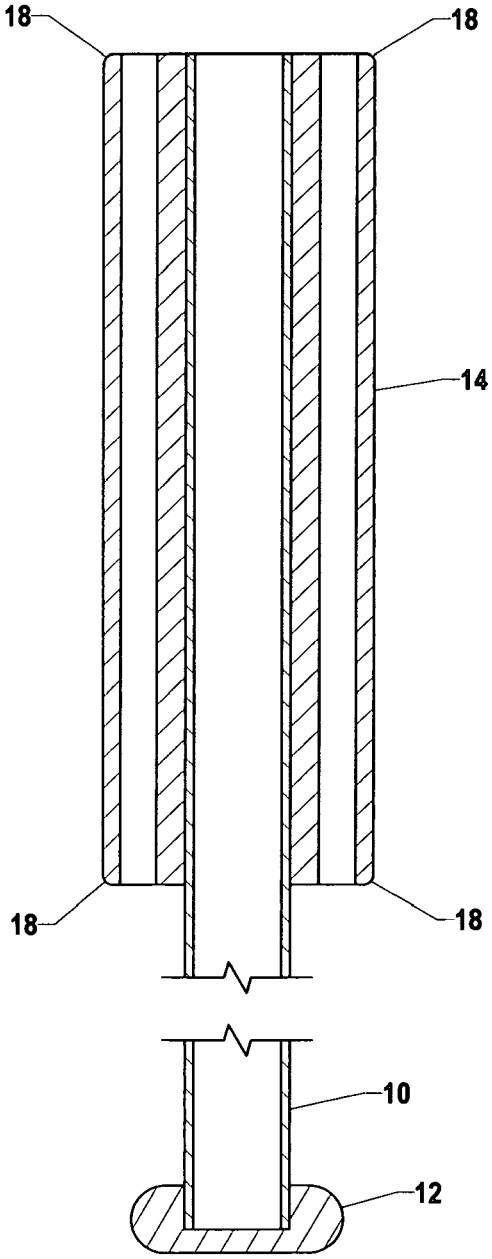
FIG. 3 is a side-sectional view of the first embodiment of the present training bat.
Figure 4:
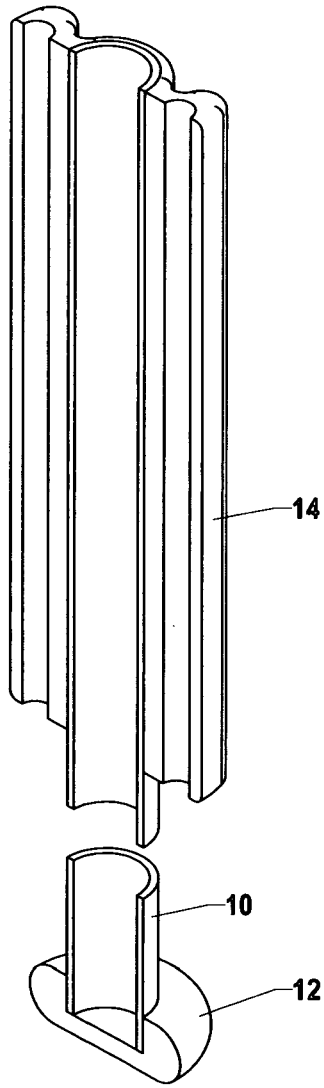
FIG. 4 is a sectional-perspective view of the first embodiment of the present training bat.

FIGS. 2-4:

Hitting portion 14 is preferably made of a length of single metal extrusion of predetermined weight which has been relieved of sharp edges at the cut-off ends 18. A top view of hitting portion is shown in FIG. 2 and features a centered bore 20, similar in size to tube, and two opposing, narrow lobes 22. The outermost surfaces of the narrow lobes serve as the striking surface 24. The striking surface 24 has a degree of convexity which is substantially similar to the degree of convexity found on the striking surface of a conventional baseball bat. The outer lobe edges 26 are rounded sufficiently to protect a standard leather-covered baseball from being cut or damaged by contact with the training bat in normal use. Holes 28 positioned within the lobes control hitting portion weight and aid in the manufacturing process of metal extrusion. A distal end 30 of tube is inserted into the centered bore 20 of hitting portion 14 and permanently attached to the hitting portion 14 by welding or otherwise bonding together. FIG. 3 and FIG. 4 show sectional views of hitting portion 14.

Handle portion 10 includes a first longitudinal axis extending along the centerline of handle portion 10. Each of the elongated lobes 22 includes a longitudinal axis extending along the centerline of holes 28 formed in lobes 22. The longitudinal axes of the elongated lobes 22 are offset from, and substantially parallel to, the longitudinal axis of the handle 10.

The training bat's swing characteristics are determined and set by length of handle portion 10 and length of hitting portion 14 which together affect overall length, weight, and balance of the training bat. Varying combinations of handle portion 10 length and hitting portion 14 length can yield swing characteristics that closely resemble conventional wood bats, composite bats, and aluminum bats certified for use in Division 1 college games. The present training bat can be custom manufactured for a player who specifies a preferred length and weight.

A major advantage of the present training bat is that is can be used to improve the wrist control needed by the batter to consistently make ball contact along the ideal edge grain area of a traditional wood bat. The edge grain area of a traditional wood bat is comprised of two narrow zones along the length of its hitting portion and positioned opposite each other. These zones of edge grain are considered to be the strongest and most dynamic parts of a traditional wood bat and thus consistent ball contact there leads to better hitting performance and longer bat life. The present training bat is configured to possess two such narrow zones only, conventionally located, with the remainder of otherwise conventional striking surface eliminated. This configuration provides both a difficult challenge for making consistent ball contact as well as distinct visual feedback of the bat's orientation in the user's hands. This configuration also provides a ball striking surface substantially similar in convexity to a conventional baseball bat and when struck properly against a ball, creates a familiar and reassuring sound substantially similar to that of a traditional wood baseball bat. Users of composite or aluminum bats also benefit from using the present training bat since improved wrist control yields a more accurate and consistent swing. Users of composite or aluminum bats who train with the present training bat will also find any future transition to traditional wood bats easier to make since they will develop the wrist control needed to properly swing a traditional wood bat.

DETAILED DESCRIPTION

Alternative Embodiment

FIG. 5

Figure 5:
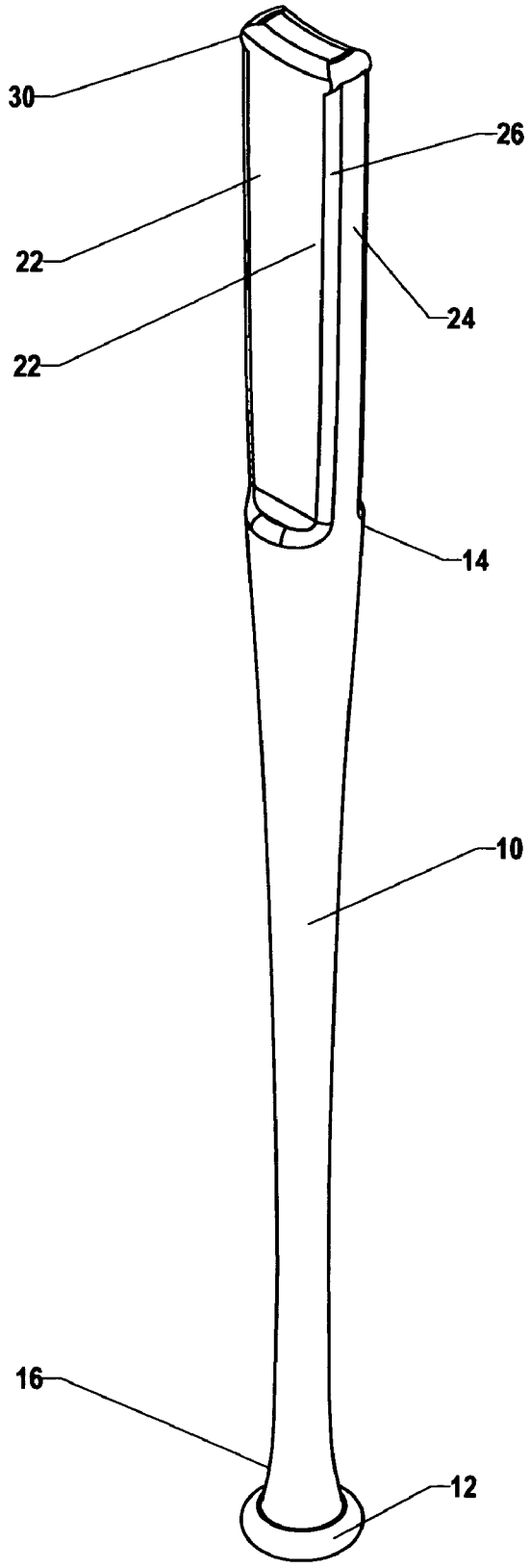
FIG. 5 is a perspective view of an alternative embodiment of the present training bat.

An alternative embodiment of the present baseball training bat is shown in a perspective view in FIG. 5. It is comprised of a single or homogeneous material such as wood, wood composite, or epoxy. It can be shaped from billet stock using conventional woodworking tools such as lathes and milling machines, or can be form molded. The narrow lobes 22 and striking surfaces 24 are positioned with respect to the bat axis similarly to those described in the First Embodiment. The outer lobe edges 26 are rounded sufficiently to protect a standard leather-covered baseball from being cut or damaged by contact with the training bat in normal use.

CONCLUSION, RAMIFICATIONS, AND SCOPE

Accordingly the reader will see that, according to one embodiment of the invention, a training bat is provided that improves swing accuracy and wrist control. Its narrow striking surface improves hand-eye coordination. It trains the hitter to not turn, or roll, the striking surface during the swing. It can be used to hit balls of all types. When skillfully used to hit a ball, it provides feel and feedback substantially similar to that of a conventional bat. It provides a training exercise that is precise and efficient.

While the above description contains many specificities, these should not be construed as limitations on the scope of any embodiment, but as exemplifications of the presently preferred embodiment thereof. Many other ramifications and variations are possible within the teachings of the invention including, but not limited to, types of materials used in construction and the amalgamation of components into single, distinct parts.

Thus, the scope of the invention should be determined by the appended claims and their legal equivalents, and not by the examples given.

I claim:

1. A baseball hitting training device comprising:

a handle having a proximal end, an opposing distal end and a first longitudinal axis; and a hitting portion located adjacent the distal end, said hitting portion including a first elongate lobe and a second elongate lobe, the first elongate lobe having a second longitudinal axis offset from and substantially parallel to the first longitudinal axis, the second elongate lobe having a third longitudinal axis offset from and substantially parallel to the first longitudinal axis, said first elongate lobe and said second elongate lobe comprising a material selected from the group consisting of metal, wood, wood composite, and epoxy;

wherein an outermost surface of said first elongate lobe and an outermost surface of said second elongate lobe each define a ball striking surface having a convex cross-section transverse to the first longitudinal axis, the ball striking surface of each elongate lobe defining an arc, the arc of each ball striking surface having a radius originating along the first longitudinal axis.

2. The training device of claim 1, wherein an outer edge of each of said ball striking surfaces is rounded.

3. The training device of claim 1, wherein the first elongate lobe includes a hole extending along a length of the first elongate lobe.

4. The training device of claim 1, wherein the first elongate lobe is a mirror image of the second elongate lobe.

5. The training device of claim 1, wherein the hitting portion is attached to the handle by welding or bonding the hitting portion to the handle.

6. A baseball hitting training device, the device comprising:

a handle having a proximal end, an opposing distal end and a first longitudinal axis; and a hitting portion located adjacent the distal end, said hitting portion including a first elongate lobe having a second longitudinal axis offset from and substantially parallel to the first longitudinal axis and a second elongate lobe having a third longitudinal axis offset from and substantially parallel to the first longitudinal axis, said first elongate lobe and said second elongate lobe comprising a rigid material;

wherein an outermost surface of said first elongate lobe and an outermost surface of said second elongate lobe each define a ball striking surface having a convex cross-section transverse to the first longitudinal axis, the ball striking surface of each elongate lobe defining an arc, the arc of each ball striking surface having its radius originating along the first longitudinal axis.

7. The training device of claim 6, wherein the first elongate lobe is a mirror image of the second elongate lobe.

8. The training device of claim 6, wherein an outer edge of each of said ball striking surfaces is rounded.

9. The training device of claim 6, wherein the first elongate lobe includes a hole extending along a length of the first elongate lobe.

10. The training device of claim 6, wherein the hitting portion is attached to the handle by welding or bonding the hitting portion to the handle.

11. The training device of claim 6, wherein the rigid material is selected from the group consisting of metal, wood, wood composite, and epoxy.

12. A baseball hitting training device, the device comprising:

a handle having a proximal end, an opposing distal end and a first longitudinal axis; and a hitting portion located adjacent the distal end, said hitting portion including a first elongate lobe offset from and substantially parallel to the first longitudinal axis and a second elongate lobe offset from and substantially parallel to the first longitudinal axis, said first elongate lobe and said second elongate lobe comprising a material selected from the group consisting of metal, wood, wood composite, and epoxy;

wherein an outermost surface of said first elongate lobe and an outermost surface of said second elongate lobe each define a ball striking surface that is convex in a cross-section transverse to the first longitudinal axis, and the ball striking surface of the first elongate lobe and the ball striking surface of the second elongate lobe each defining an arc, the arc of the ball striking surface of the first elongate lobe having a radius originating along the first longitudinal axis and the arc of the ball striking surface of the second elongate lobe having a radius originating along the first longitudinal axis.

13. The training device of claim 12, wherein the hitting portion is attached to the handle by welding or bonding the hitting portion to the handle.

* * * * *